United States Patent [19]

Kubota

[11] Patent Number: 4,703,932

[45] Date of Patent: Nov. 3, 1987

[54] POLICE BATON WITH HOOKED CROSSHANDLE

[76] Inventor: Takayuki Kubota, 1436 Ardmore Ave., Glendale, Calif. 91202

[21] Appl. No.: 871,284

[22] Filed: Jun. 6, 1986

[51] Int. Cl.[4] ..... A63B 59/00

[52] U.S. Cl. ..... 273/84 R; 273/67 R; 84/477 B

[58] Field of Search ..... 273/84 R, 81 R, 81 C, 273/73 H, 73 J, 67 R, 84 ES; 84/477 B; D22/117; D21/100, 145, 211

[56] References Cited

U.S. PATENT DOCUMENTS

| | | | |
|---|---|---|---|
| D. 230,150 | 1/1974 | Anderson | D22/117 |
| 3,125,287 | 3/1964 | Roehm | 273/84 R |
| 3,518,024 | 6/1970 | Wilson | 273/67 R |
| 4,109,912 | 8/1978 | Zentmyer | 273/84 R |
| 4,132,409 | 1/1979 | Taylor | 273/84 R |
| 4,203,599 | 5/1980 | Starrett | 273/84 R |
| 4,479,171 | 10/1984 | Mains | 273/84 R |

OTHER PUBLICATIONS

"Black Belt", Feb. 1982, vol. 20, No. 2, p. 86, Walk Legal Walk Safe.

*Primary Examiner*—Andrew V. Kundrat

*Attorney, Agent, or Firm*—Freilich, Hornbaker Rosen & Fernandez

[57] ABSTRACT

A police baton having a crosshandle is provided with a short shaft on the free end of the crosshandle. The short shaft extends parallel to the baton to form a hook near one end of the baton that may be used to hook a limb of a person to be brought under control. The short shaft allows the baton to be used in other ways, such as to swing freely in a loosened grip without risk of the crosshandle slipping out of the loosened grip.

3 Claims, 9 Drawing Figures

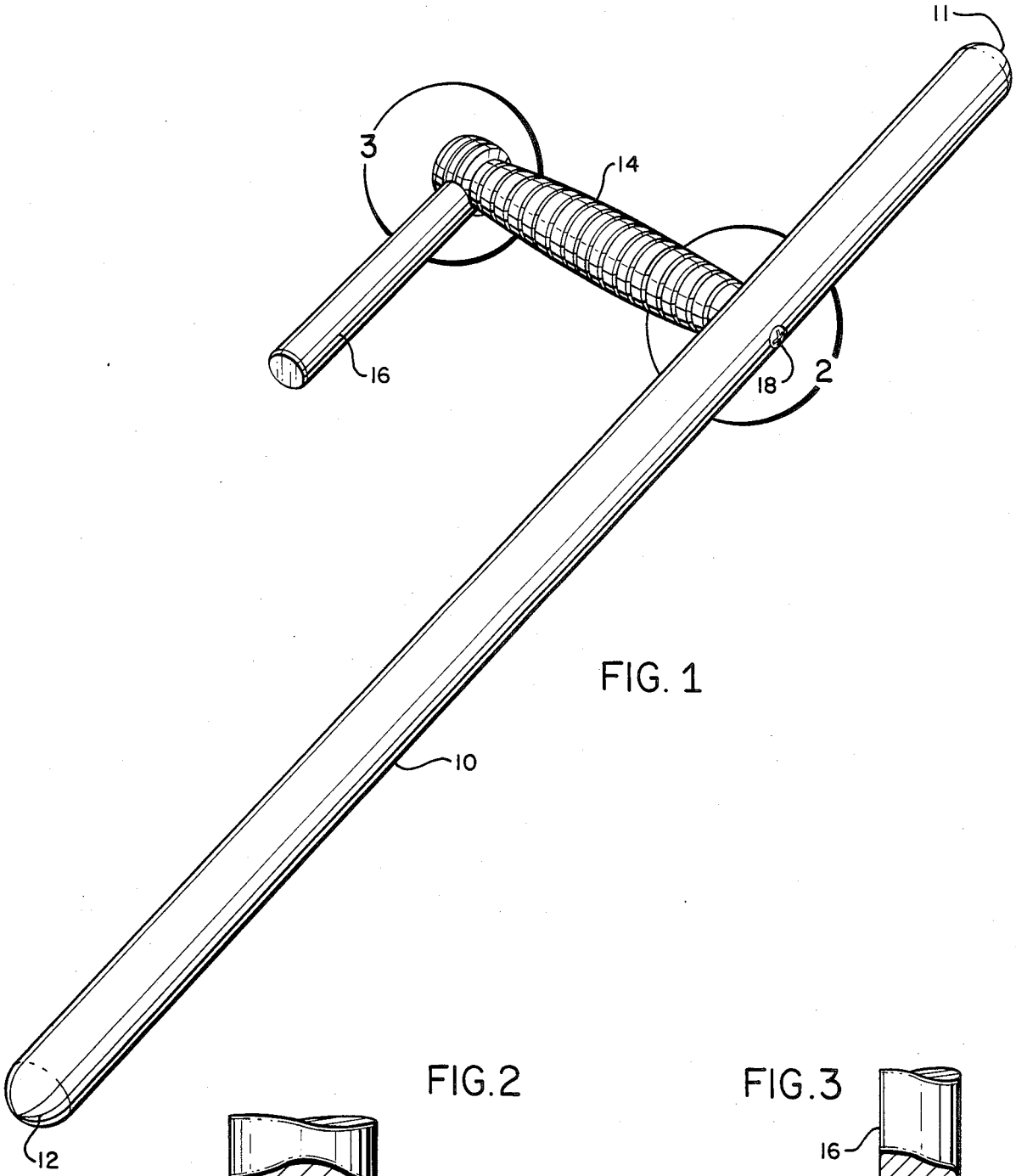
FIG. 1
FIG. 2
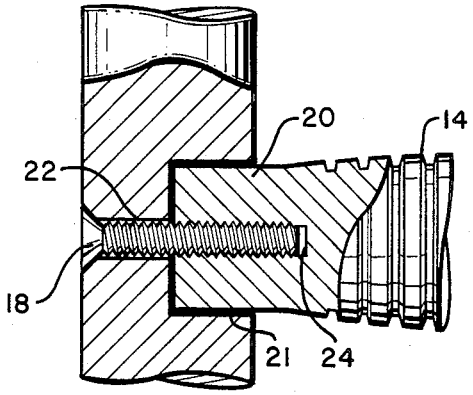
FIG. 3
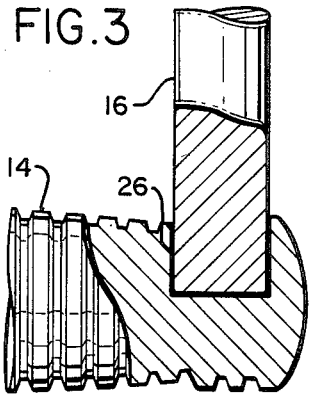

POLICE BATON WITH HOOKED CROSSHANDLE

BACKGROUND OF THE INVENTION

This invention relates to a police baton, and more particularly a police baton having a crosshandle as shown in U.S. Pat. Nos. 4,132,409 and Des. 230,150.

As noted in the U.S. Pat. No. 4,132,409, a baton or nightstick with a crosshandle is believed to have been first used by police officers on Okinawa Island, and one style of this type of baton is shown in the U.S. Pat. No. Des. 230,150 which uses a rigid crosshandle.

One use of the crosshandle is for swinging the baton proper in a generally horizontal plane, once the grip on the crosshandle is loosened sufficiently to permit the crosshandle to pivot in the hand while the baton sweeps across at a greater velocity than is possible with a firm grip. The U.S. Pat. No. 4,132,409 discloses a crosshandle intended for use in this sweeping way. To facilitate this sweeping action, a sleeve is provided on a shank over that half of the crosshandle nearest the baton proper. By loosening the grip on the outer half of the crosshandle, while maintaining a firms grip on the inner half between the thumb and index finger, the baton will pivot freely in the rotatable sleeve without any risk of the crosshandle working up out of the hand.

Another possible use of a baton with a crosshandle is as a hook to reach out and engage a limb of a person being brought under control while resisting arrest, much as one might use a cane, However, the crosshandle of a baton is straight and perpendicular to the barton proper. As a consequence, the force which a limb thus being engaged exerts on the baton is such as to cause the hand holding the baton to be twisted, allowing the baton to move away from the limb being engaged. In that manner, the person being brought under control may easily disengage his limb from the crosshandle.

SUMMARY OF THE INVENTION

In accordance with the present invention, the uses of a baton having a crosshandle perpendicular to the baton near one end is greatly improved by a short shaft extending from the free end of the crosshandle parallel to the baton proper in a direction away from the one end. This creates a hook out of the crosshandle, and without impairing the uses of the baton that rely on the crosshandle, the hook enables the user to engage the arm of a person being brought under control. Other advantages will become apparent from the following description of preferred embodiments.

BRIEF DESCRIPTION OF THE DRAWINGS

FIG. 1 is a isometric view of the present invention.

FIG. 2 is a sectional view of a portion within the circle 2 in FIG. 1.

FIG. 3 is a sectional view of a portion within the circle 3 in FIG. 1.

DESCRIPTION OF PREFERRED EMOBODIMENTS

Figure 4A:
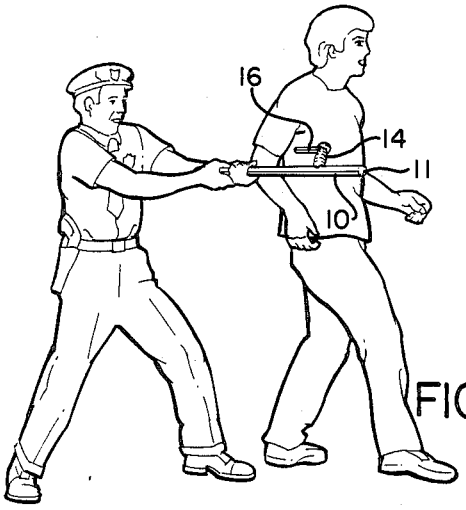
FIGS. 4*a, b, c* and *d* illustrate one way to use the present invention.
Figure 4B:
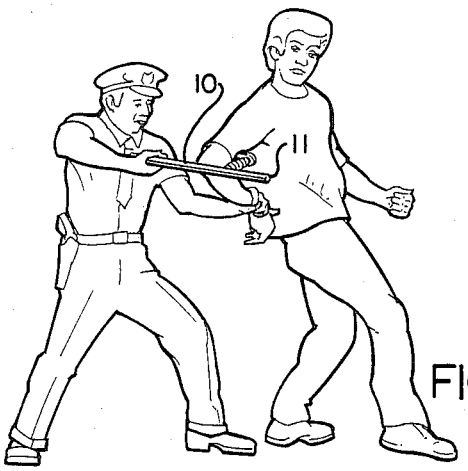
Figure 4C:
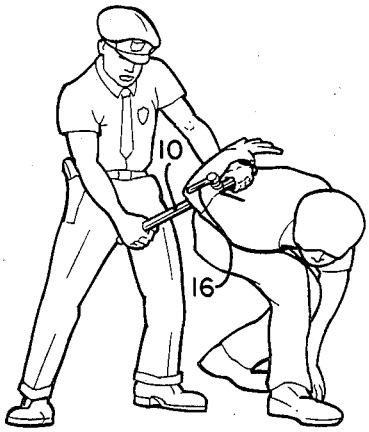

An improved crosshandle baton shown in FIG. 1 is comprised of an elongated shaft 10 (sometimes referred to herein as the baton) that is preferably rounded at ends 11 and 12, a crosshandle 14, and a cylindrical short shaft

16 at the free end of the crosshandle 14. That short shaft is parallel to the elongated shaft 10, and extends in a direction away from the end 11 nearest the crosshandle, leaving a section near the end 11 as a handle for the baton.

The crosshandle is secured to the baton 10 by a screw 18, as illustrated in FIG. 2 in a cross section of a portion enclosed by a circle 2 in FIG. 1, once the cylindrical end 20 of the crosshandle is press fitted into a blind hole 21 in the baton. A hole 22 is drilled through the baton to receive the screw, and a blind hole 24 is tapped into the end of the crosshandle to receive the threaded screw 18. Once assembled in this way, the crosshandle is rigidly attached to the baton 10.

The short shaft 16 is press fitted into a blind hole 26, as shown in FIG. 3. A screw through the crosshandle 14 into the short shaft 16 could be provided to further secure the short shaft in place, but that is not deemed necessary in view of the fact that this improved baton with a crosshandle is normally grasped by either end 11 or 12 of the baton 10, or the crosshandle 14, and not by the short shaft 16.

The length of the baton is typically 21 or 24 inches, with the crosshandle connected about 6 inches from the one end 11. The short shaft 16 is spaced about $5\frac{1}{2}$ inches from the baton, center to center. The diameter of the baton 10 is typically $1\frac{1}{4}$ inches, and the diameter of the shaft 16 need by only $\frac{5}{8}$ inches. Consequently, the space left for the hand on the crosshandle is about 4 9/16 inches. The short shaft is about $4\frac{1}{2}$ inches long.

While the baton is grasped by the crosshandle 14, the grip may be loosened to swing the shaft 10 in a horizontal plane while sweeping the front and/or sides of the user, in the same manner as recommended for the baton of the aforesaid patent having a rotatable sleeve over the crosshandle. Such a sleeve could be provided on the crosshandle 14 between the baton 10 and the short shaft 16, but it is preferable to not do so in order that the user may grasp the crosshandle 14 firmly and prevent it from turning in his hand, such as while holding the baton by the crosshandle with the end 12 of the shaft 10 exteding out to poke an aggressor in the stomach or chest, or with the long end of the baton 10 extending along the forearm to protect it while using it to fend off blows to his head and shoulders, while at the same time protecting the forearm from the blows. At the same time, the short shaft 16 will provide protection from the thumb back to the wrist.

Figure 4D:
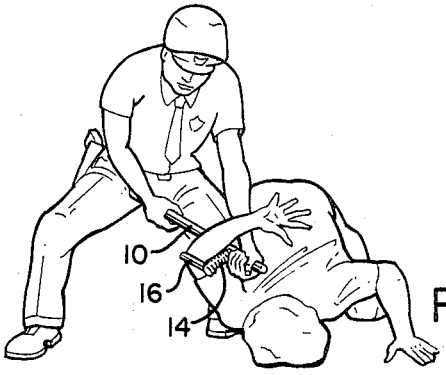

Other ways to use the improved baton shown in FIG. 1 to advantage will occur to those skilled in using the baton. Two important ways are illustrated in FIGS. 4*a–d* and 5*a–b*, the object of which is to engage the limb of a person who is to be brought under control. FIGS. 4*a–d* illustrate a situation in which the person is moving away from a police officer. By grasping the baton at the end 12 remote from the crosshandle 14, the short shaft 16 of the baton 10 is slipped between the arm and the body (FIG. 4*a*). The hook formed by the short shaft 16 and the crosshandle 14 allows the officer to effecitvely pull the person back and off balance. Then, seizing the opportunity while the person is off balance, the person is grasped by the wrist (FIG. 4*b*) to twist the arm behind his back. By grasping the baton 10 at the end 11 near the crosshandle 14 with the left hand, the officer can lock the person's arm behind him, while pressing forward and to the right. This will force the person to the ground (FIG. 4*d*).

Figure 5A:
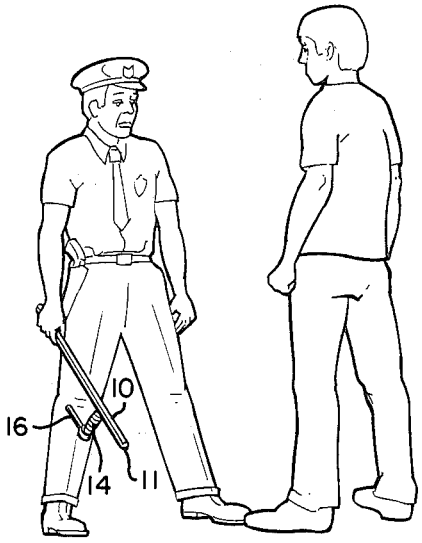
FIGS. 5*a* and 5*b* illustrate another way to use the present invention.
Figure 5B:
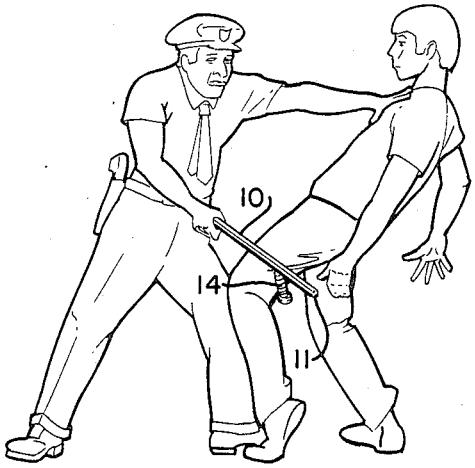

The other way to use the improved baton 10 is to hook a leg while taking down a confronting person, as illustrated in FIGS. 5*a* and 5*b*. Again, by grasping the baton at the end 12 (FIG. 5*a*), the officer may quickly reach out with the baton, and while holding his left arm out in front, hook the baton behind the leg of the confronting person (FIG. 5*b*). This will allow the officer to take the person down without permitting the person being brought under ontrol to reach the officer with his hands. With some practice, the take down may be executed very smoothly. This is particularly the case when there is the element of surprise as to what the officer intends to do with the baton during the confrontation illustrated in FIG. 5*a*.

Although particular embodiments of the invention, and ways of using it, have been illustrated and described, it is recognized that other embodiments and ways of usng the invention may readily occur to those skilled in the art. For example, the crosshandle and short shaft may be one integral L-shaped element press fitted into a hole in the baton, and further secured by a screw if desired. Consequently, it is intended that the claims be interpreted to cover such other embodiments.

What is claimed is:

1. In a police baton comprised of an elongated cylindrical shaft having a first end and a second end, a crosshandle of length less than said elongated cylindrical shaft, said crosshandle having one end attached to said elongated cylindrical shaft at a position that is spaced away from said first end of said elongated cylindrical shaft a distance approximately equal to the length of said crosshandle, said crosshandle being affixed to said elongated cylindrical shaft perpendicular thereto, an improvement comprised of a cylindrical shaft shorter than said elongated cylindrical shaft, said shorter shaft being attached to said crosshandle near an end thereof opposite said one end, said shorter shaft being affixed to said crosshandle in a position parallel to said elongated cylindrical shaft and extending in a direction toward said second end of said elongated cylindrical shaft.

2. An improvement as defined in claim 1 wherein said shorter shaft extending from said crosshandle is about the same length as said crosshandle.

3. An improvement as defined in claim 1 or 2 wherein said shorter shaft is press fitted into a hole in said crosshandle.

* * * * *